US007062214B2

(12) United States Patent
Moriyama

(10) Patent No.: US 7,062,214 B2
(45) Date of Patent: Jun. 13, 2006

(54) IMAGE FORMING APPARATUS WITH PAPER THICKNESS DETECTION UNIT FOR DETECTING OVERLAP OF REGULAR AND INSERTION SHEETS

(75) Inventor: Tsuyoshi Moriyama, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 10/314,290

(22) Filed: Dec. 9, 2002

(65) Prior Publication Data

US 2003/0118384 A1 Jun. 26, 2003

(30) Foreign Application Priority Data

Dec. 26, 2001 (JP) ..... 2001-394083

(51) Int. Cl.
*G03G 15/00* (2006.01)

(52) U.S. Cl. ..... 399/382

(58) Field of Classification Search ..... 399/382, 399/392, 403, 405, 82
See application file for complete search history.

(56) References Cited

U.S. PATENT DOCUMENTS

| | | | | |
|---|---|---|---|---|
| 5,710,968 | A * | 1/1998 | Clark et al. | 399/382 |
| 5,836,580 | A * | 11/1998 | Hansen et al. | 271/9.13 |
| 6,219,503 | B1 | 4/2001 | Miyake et al. | 399/85 |
| 6,304,743 | B1 * | 10/2001 | Fujii et al. | 399/374 |
| 6,330,422 | B1 | 12/2001 | Sato et al. | 399/382 |
| 6,337,970 | B1 | 1/2002 | Okamoto et al. | 399/407 |
| 6,386,080 | B1 | 5/2002 | Okamoto et al. | 83/73 |
| 6,421,073 | B1 * | 7/2002 | Dietel et al. | 347/110 |
| 6,505,017 | B1 | 1/2003 | Fujii et al. | 399/82 |
| 6,633,733 | B1 * | 10/2003 | Mochimaru et al. | 399/45 |
| 2003/0038015 | A1 * | 2/2003 | Rosello | 194/207 |

FOREIGN PATENT DOCUMENTS

| | | | |
|---|---|---|---|
| JP | 60-180894 | | 9/1985 |
| JP | 60-191932 | | 9/1985 |
| JP | 60-204564 | | 10/1985 |
| JP | 63234268 | A * | 9/1988 |
| JP | 06321404 | A * | 11/1994 |
| JP | 09142699 | A * | 6/1997 |
| JP | 11-24512 | * | 1/1999 |
| JP | 2003-112840 | * | 4/2003 |
| JP | 2003263076 | A * | 9/2003 |

OTHER PUBLICATIONS

Partial translation of JP406321404A to Wakao et al.*

* cited by examiner

*Primary Examiner*—Quana Grainger
(74) *Attorney, Agent, or Firm*—Fitzpatrick, Cella, Harper & Scinto

(57) ABSTRACT

An image forming apparatus has a first stacking unit for stacking regular sheets on which images are formed, an image forming unit for forming an image on a regular sheet fed from the first stacking unit, a second stacking unit for stacking the insertion sheets, a delivery unit for discharging the regular sheets from the image forming unit and the insertion sheets from the second stacking unit into a single sheet discharge section, and a paper thickness detection unit provided on a common carrier path through which the regular sheets carried from the image forming unit and the insertion sheets delivered from the second stacking unit are transported for detecting the thickness of the regular sheets and the insertion sheets.

10 Claims, 13 Drawing Sheets

IMAGE FORMING APPARATUS WITH PAPER THICKNESS DETECTION UNIT FOR DETECTING OVERLAP OF REGULAR AND INSERTION SHEETS

BACKGROUND OF THE INVENTION

1. Field of the Invention

The present invention relates to an image forming apparatus that is capable of detecting the overlapped feeding of regular sheets and insertion sheets.

2. Description of the Related Art

Hitherto, in an image forming apparatus such as a copying machine, a mode (hereinafter referred to as "insertion mode") for inserting a front cover, a back cover, or an intermediate insertion sheet (hereinafter referred to as "insertion sheet") is provided. In the insertion mode, insertion of the front cover, the back cover, or an intermediate insertion sheet may be performed by controlling the apparatus to feed the first page, the last page, or the predetermined page in its correct position from a predetermined feed unit, and to feed other regular pages from a paper feed unit different from the predetermined feed unit.

Provision of the predetermined feed unit for feeding the insertion sheet at the sheet processing unit (finisher) to be mounted on the image forming apparatus enables insertion of the insertion sheet without causing a damage thereto by a heat and pressure because the insertion sheets are fed without passing the front cover and the like having an image formed thereon in advance through the image forming apparatus, or without passing them through a fixing unit in an electrophotographic image forming apparatus. The sheet processing unit for feeding the insertion sheet is set forth in Japanese Patent Laid-Open No. 60-180894, Japanese Patent Laid-Open No. 60-191932, and Japanese Patent Laid-Open No. 60-204564.

When feeding the insertion sheets that are pre-printed with images, a front cover, an intermediate insertion sheet, and a back cover are stacked in order and set in the sheet processing unit. Therefore, when feeding the insertion sheets that are pre-printed with images, the insertion sheets fed from the feed unit must be reliably fed into the sheet processing unit one by one.

However, since various types of paper are used for the insertion sheets, there may be a case in which feeding of two, instead of one, sheets simultaneously, so called overlapped feed, may occur, which causes a problem that the order of the sheets to be fed from then on may be out of sequence.

SUMMARY OF THE INVENTION

It is an object of the present invention to provide an image forming apparatus that is capable of detecting overlapped feeding of the sheets at a low cost in a simple construction so that wasted image formation after occurrence of overlapped feeding may be prevented.

The present invention provides an image forming apparatus including a first stacking unit for stacking regular sheets on which images are formed, an image forming unit for forming an image on a regular sheet fed from the first stacking unit, a second stacking unit for stacking the insertion sheets, a delivery unit for discharging sheets fed from the second stacking unit to a single paper discharge section, and a paper thickness detection unit provided on a common carrier path through which the regular sheets carried from the image forming unit and the insertion sheets delivered from the second stacking unit are transported for detecting the thickness of the regular sheets and the insertion sheets.

Preferably, the paper thickness detection unit includes a movable magnetic body and a magnetic field sensor.

In another embodiment, the paper thickness detection unit includes a pair of rollers and an amount of displacement detection unit for detecting the amount of displacement of at least one of the rollers.

Preferably, the paper thickness detection unit is located downstream of the meeting place for a path from the first stacking unit and a path from the image forming unit.

Preferably, the second stacking unit is located downstream of the image forming unit.

In yet another respect, the image forming apparatus further includes a comparing unit for comparing the thickness of each page of the first copy detected by the paper thickness detection unit with the thickness of each page from the second copy onward, and a warning unit for providing a warning notifying the user of an overlapped feeding of the regular sheets or the insertion sheets based on the comparison result of the comparing unit.

The warning unit may also provide a warning notifying the user of an overlapped feeding when the thickness of the each page from the second copy onward is larger than the value obtained by multiplying the thickness of each page of the first copy by a predetermined coefficient.

In still yet another respect, the invention provides an image forming apparatus including a first stacking unit for stacking regular sheets on which images are formed, an image forming unit for forming an image on a regular sheet fed from the first stacking unit, a second stacking unit for stacking the insertion sheets, a delivery unit for discharging the regular sheets fed from the image forming unit and the insertion sheets from the second stacking unit to a single sheet discharge unit, a paper thickness detection unit for detecting the thickness of the insertion sheet fed from the second stacking unit and the regular sheet carried from the image forming unit, a feed control unit for suspending feed of the regular sheets and the insertion sheets in accordance with the feed of the regular sheets and the insertion sheets of the first copy, and restarting feed of the regular sheets and the insertion sheets from the second copy onward when a continuation instruction is issued from the operation panel, and a warning unit for providing a warning notifying the user of an overlapped feeding when the thickness of the each page from the second copy onward is larger than the value obtained by multiplying the thickness of each page of the first copy by a predetermined coefficient.

Further objects, features and advantages of the present invention will become apparent from the following description with reference to the attached drawings.

DESCRIPTION OF THE PREFERRED EMBODIMENTS

Figure 1:
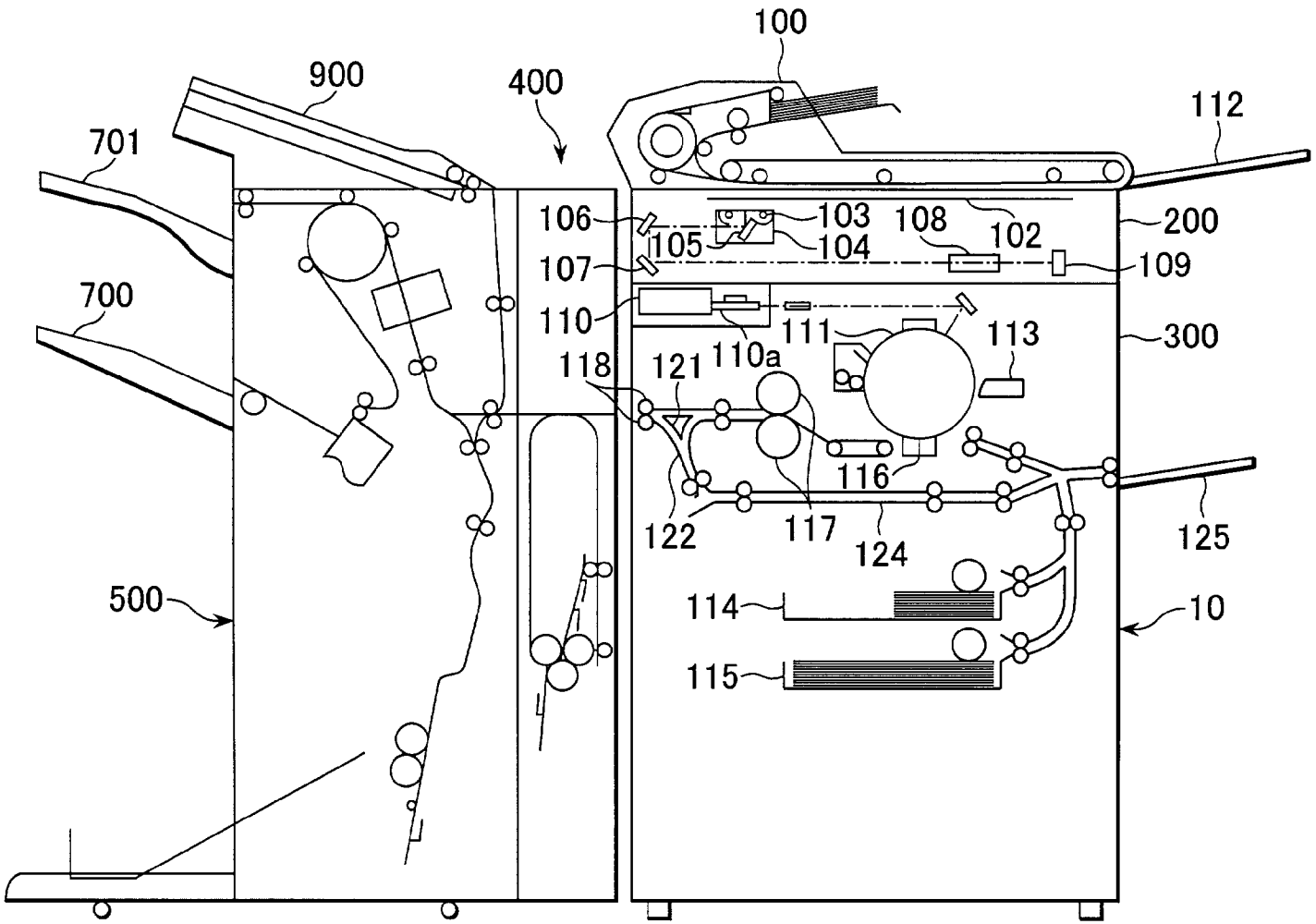
FIG. 1 is a vertical cross sectional view showing an image forming apparatus according to an embodiment of the invention.

Referring now to the drawings, an embodiment of the invention will be described.

(Entire Construction)

FIG. 1 is a vertical cross sectional view showing an image forming apparatus according to an embodiment of the present invention. As shown in FIG. 1, the image forming apparatus includes an image forming apparatus body 10, a folding unit 400, and a finisher 500. The image forming apparatus body 10 includes an image reader 200 for reading an image of a manuscript and a printer 300.

The image reader 200 includes a manuscript feed unit 100 mounted thereon. The manuscript feed unit 100 feeds manuscripts set on a manuscript tray with the face up sequentially from the first page toward the left one by one, then the manuscript passes through a curved path, moves on the platen glass 102 from the left through the flow-reading point to the right, and is discharged onto a discharge tray 112 on the outside. When the manuscript passes over the flow-leading point on the platen glass 102 from the left to the right, the image of the manuscript is read by a scanner unit 104 held at the position corresponding to the flow-reading point. This reading method is generally called flowing manuscript scanning. More specifically, when the manuscript passes through the flow-reading point, the surface of the manuscript to be read is irradiated by light from a lamp 103 of a scanner unit 104, and then light reflected from the manuscript is guided to a lens 108 via mirrors 105, 106, 107. The light passing through the lens 108 forms an image on the image pickup plane of an image sensor 109.

By carrying the manuscript from the left through the flow-reading point to the right, the manuscript is scanned in the direction orthogonal to the direction of travel of the manuscript, which is the main scanning direction, and in the direction of travel, which is the sub scanning direction. In other words, the image of the manuscript is read by the image sensor 109 line by line in the main scanning direction when the manuscript passes through the flow-reading point, and simultaneously, the entire image of the manuscript is read by carrying the manuscript in the sub scanning direction. The optically read image is converted into image data by the image sensor 109, and is then output. The image data output from the image sensor 109 is subjected to a predetermined process in an image signal controller 202 that will be described later, and then is input into a exposure controller 110 of a printer 300 as video signals.

It is also possible to read the manuscript by carrying the manuscript onto the platen glass 102 by the manuscript feed unit 100 and suspending it at a predetermined position, and in this state, allowing a scanner unit 104 to scan from the left to the right. This reading method is fixed manuscript scanning.

When reading the manuscript without using the manuscript feed unit 100, the user lifts the manuscript feed unit 100 and places the manuscript on the platen glass 102, and then allows the scanner unit 104 to scan from the left to the right. In other words, when reading the manuscript without using the manuscript feed unit 100, fixed manuscript reading is carried out.

The exposure controller 110 of the printer 300 modulates a laser beam based on the supplied video signals. The output laser beam is irradiated on a photoreceptor drum 111 while being scanned by a polygon mirror 110*a*. The photoreceptor drum 111 is formed with a electrostatic latent image corresponding to the scanned laser beam. The exposure controller 110 outputs the laser beam so that a correct image (image which is not a mirror image) is formed when the image is read by fixed manuscript reading.

The electrostatic latent image formed on the photoreceptor drum 111 is visualized by developer fed from a processing machine 113 as a developer image. A sheet is fed from each cassette 114, 115, manual paper feeder 125, or a duplex carrying path 124 at a timing simultaneous with initiation of irradiation of the laser beam, and the sheet is fed between the photoreceptor drum 111 and the transfer section 116. The developed image formed on the photoreceptor drum 111 is transferred onto the sheet fed from the transfer section 116.

The sheet on which the developed image is transferred is carried to the fixing unit 117, and the fixing unit 117 fixes the developed image on the sheet by heat-pressurizing the sheet. The sheet passed through the fixing unit 117 passes through the flapper 121 and the discharge roller 118, and discharged outside of the printer 300 (toward folding unit 400).

In order to discharge the sheet formed with the image faced downward (faced down), the sheet having passed through the fixing unit 117 is guided once into a reverse path 122 by switching the flapper 121, and after the trailing edge of the sheet passes through the flapper 121, the sheet is reversed and discharged from the printer 300 by the discharge roller 118. Hereinafter, such mode of discharging a sheet is called reverse discharge. The reverse discharge is carried out when forming an image in order from the front page, such as the case of forming an image read by the use of the manuscript feed unit 100 or of forming the image output from the computer, and thus the sheets after having been discharged are piled correctly in order by page number.

When a hard sheet such as OHP sheet is fed from the manual paper feed unit 125 for forming an image on this sheet, the sheet is discharged by the discharge roller 118 with the side formed with an image faced upward (face up) without diverting the sheet into the reverse path 122.

When duplex printing for forming imaged on both sides of the sheet is set, the sheet is guided into the reverse path 122 once by the switching action of the flapper 121, and then is carried into the duplex carrying path 124, and the sheet guided into the duplex carrying path 124 is fed again between the photoreceptor drum 111 and the transfer section 116 at the timing described above.

The sheet discharged from the printer 300 is fed to the folding unit 400. The folding unit 400 folds the sheet into a Z-shape. For example, when a sheet of size/A3 or size/B4 is used and the folding process is assigned, the sheets is folded by the folding unit 400. Otherwise, the sheet discharged from the printer 300 is passed through the folding unit 400 and fed to the finisher 500. The finisher 500 is provided with an inserter 900 for feeding special sheets such as a front cover or an intermediate insertion sheet to the regular sheets on which the images are formed. The finisher 500 performs a bookbinding process, a stitching process, or a punching process.

(System Block Diagram)

Figure 2:
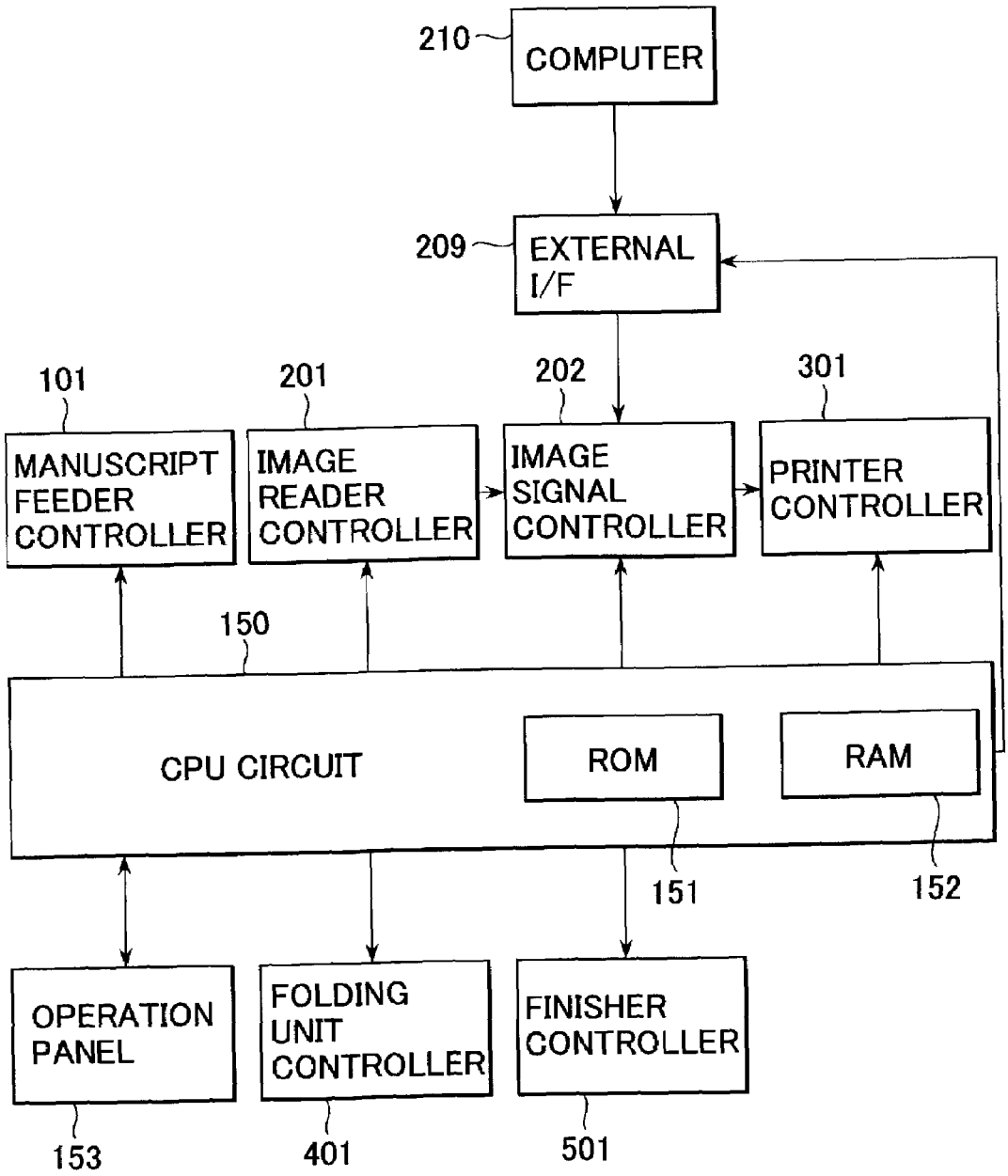
FIG. 2 is a block diagram of a controller for controlling the entire image forming apparatus.

Subsequently, referring now to FIG. 2, the construction of a controller for controlling the image forming apparatus of the invention as a whole will be described. FIG. 2 is a block diagram of a controller for controlling the image forming apparatus shown in FIG. 1 as a whole.

The controller includes, as shown in FIG. 2, a CPU circuit unit 150, and the CPU circuit unit 150 includes a CPU (not shown in the figure), a ROM 151, and a RAM 152 integrated therein, and the control program stored in the ROM 151 controls the respective blocks 101, 153, 201, 202, 209, 301, 401, 501. The RAM 152 stores control data temporarily, and is used as a work area for computing process in conjunction with control.

The manuscript feeder controller 101 controls the operation of the manuscript feed unit 100 based on the instructions from the CPU circuit unit 150. The image reader controller 201 controls the operation of the scanner unit 104 and the image sensor 109 described above to transfer the analogue image signals fed from the image sensor 109 to the image signal controller 202.

The image signal controller 202 performs the respective processes after converting the analogue image signals from the image sensor 109 into digital signals, then, converts the digital signals into the video signals and are outputs them to the printer controller 301. The digital image signals input from the computer 210 through the external I/F 209 are subjected to the various processes, and these digital image signals are converted into the video signals and are output into the printer controller 301. The processes performed by the image signal controller 202 are controlled by the CPU circuit unit 150. The printer controller 301 drives the above-described exposure controller 110 based on the input video signals.

The operation panel 153 includes a plurality of keys for setting various functions concerning formation of images and a display for displaying information indicating the setting state. The operation panel 153 outputs key signals corresponding to the operation of the respective keys to the CPU circuit unit 150, and displays corresponding information based on the signals supplied from the CPU circuit unit 150 on the display.

The folding unit controller 401 is mounted on the folding unit 400, and controls the operation of the entire folding unit by exchanging information with the CPU circuit unit 150.

The finisher controller 501 is mounted on the finisher 500, and controls the operation of the entire finisher by exchanging information with the CPU circuit unit 150. The method of controlling the finisher will be described later.

(Finisher Main Unit)

The finisher 500 receives the sheets discharged through the folding unit 400 sequentially and performs various post-processes such as a binding process to align and bind those pluralities of sheets into a bundle, a stapling process to place staples at the trailing edge of the bundle of sheets, a punching process to punch the sheets near the trailing edge, a sorting process, a non-sorting process, and a bookbinding process.

Figure 3:
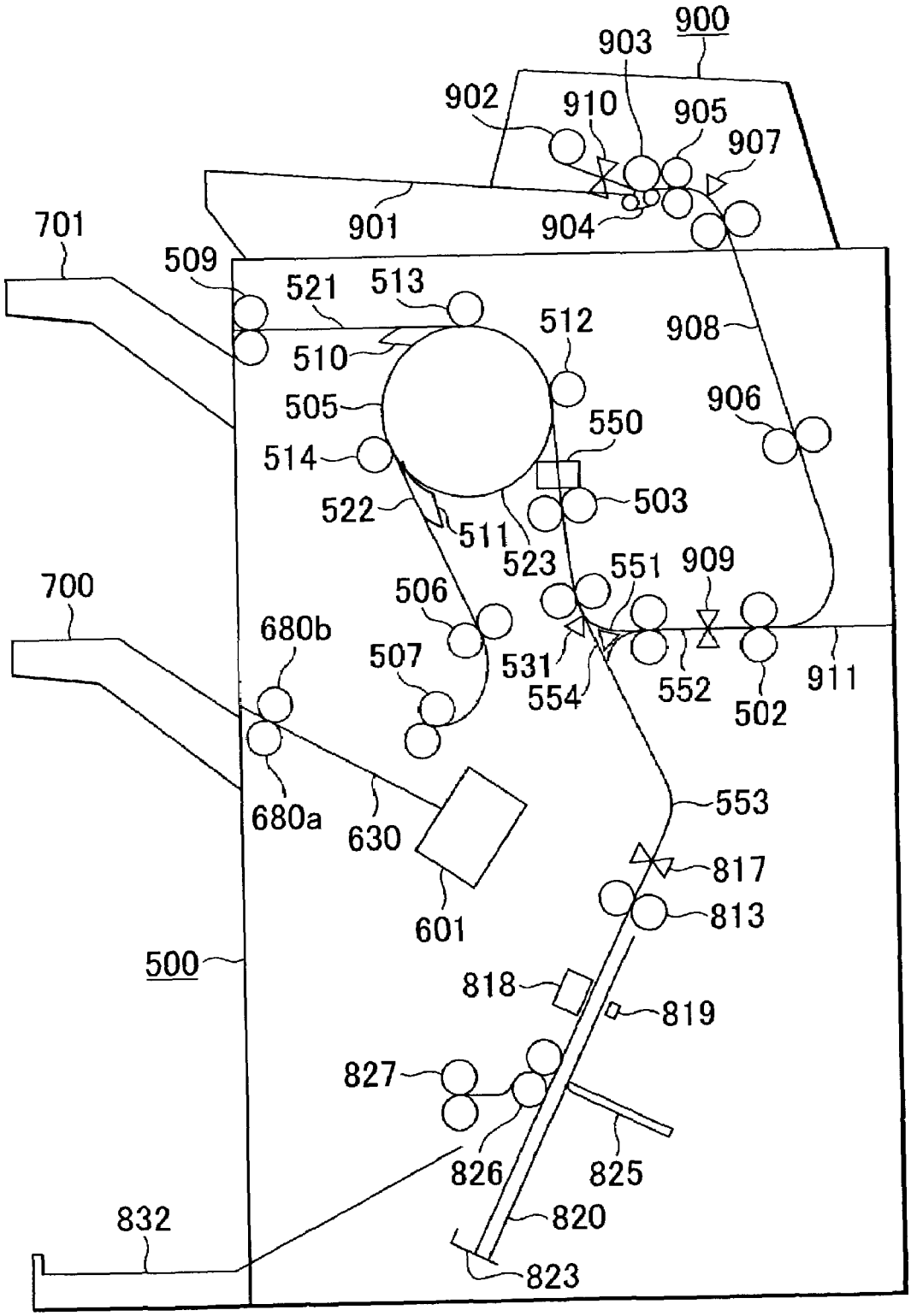
FIG. 3 is a cross sectional view of a finisher.

The finisher 500 includes, as shown in FIG. 3, a pair of entrance rollers 502 for guiding the sheet discharged from the printer 300 through the folding unit 400 into the finisher 500. A switchover flapper 551 for guiding the sheet to the finisher path 552 or to the first bookbinding path 553 is provided downstream of the pair of entrance rollers 502.

The sheet guided into the finisher path 552 is fed toward a buffer roller 505 through a pair of carrier rollers 503. The pair of carrier rollers 503 and the buffer roller 505 are rotatable in both directions.

An entrance sensor 531 is provided between the pair of entrance rollers 502 and the pair of carrier rollers 503. A second bookbinding path 554 is branched from the finisher path 552 near the entrance sensor 531 upstream thereof in the direction of conveyance. This branch point constitutes a branch leading to the carrier path for carrying the sheets from the pair of entrance rollers 502 to the pair of carrier rollers 503. However, when the pair of carrier rollers 503 rotate in the reverse direction and carry the sheets from the pair of carrier rollers 503 toward the entrance sensor 531, it constitutes a branch point having a one-way mechanism for carrying the sheets only toward the second bookbinding path 554.

Provided between the pair of carrier rollers 503 and the buffer roller 505 is a punching unit 550, which is activated as needed to punch the fed sheets near the trailing edge.

The buffer roller 505 is a roller which allows winding of a predetermined number of fed sheets in piles on the outer periphery thereof. Those sheets are wound on the buffer roller with the aid of the press rollers 512, 513, 514 as needed. The sheets wound around the buffer roller 505 is carried in the direction of rotation of the buffer roller 505.

A switchover flapper 510 is disposed between the press rollers 513, 514 and a switchover flapper 511 is disposed downstream of the press roller 514. The switchover flapper 510 is a flapper for peeling the sheets wound around the buffer roller 505 therefrom and leading them into the non-sort path 521 or to the sort path 522, while the changeover flapper 511 is a flapper for leading the sheets wound around the buffer roller 505 into the sort path 522 while peeling them from the buffer roller 505, or to the buffer path 523 in the state of being wound thereon.

The sheets lead into the non-sort path 521 by the changeover flapper 510 is discharged onto the sample tray 701 via the pair of discharge rollers 509. The sheets lead into the sort path 522 by the changeover flapper 510 is stacked on the intermediate tray (hereinafter referred to as a process tray) 630 via the carrier roller 506, 507. The sheets stacked on the process tray 630 in a bundled state are subjected to the aligning process and the stapling process as needed, and then discharged on the stack tray 700 by the discharge rollers 680*a*, 680*b*. In the stapling process for binding the sheets stacked in a bundle on the process tray 630, a stapler 601 is used. The stack tray 700 is capable of traveling in the vertical direction.

(Bookbinding Unit)

The sheets fed from a first bookbinding path 553 and a second bookbinding path 554 is stored in a storage guide 820 by a pair of carrier rollers 813, and then carried until the leading edges of the sheets come into contact with a movable sheet positioning member 823. A bookbinding entrance sensor 817 is disposed upstream of the pair of carrier rollers 813. Two pairs of staplers 818 are provided en route to the storage guide 820. These staplers 818 are adapted to bind the center of the bundle of sheets in cooperation with an anvil 819 opposing thereto.

A pair of folding rollers 826 is provided downstream of the staplers 818. A projecting member 825 is provided at the position opposing to the pair of folding rollers 816. Projection of the projecting member 825 toward the bundle of sheets stored in the storage guide 820 allows the bundle of sheets to be pushed into the nip of the pair of folding rollers 826, folded by the pair of folding rollers 826, and discharged onto the saddle discharge tray 832 via the folded paper discharge roller 827. A bind sheets sensor 830 is disposed downstream of the folded paper discharge roller 827.

When folding the bundle of sheets bound by the stapler 818, the positioning member 823 is moved downward by a predetermined distance after the stapling process so that the stapled position of the bundle of sheets comes to the center of the pair of folding rollers 826.

(Inserter Unit)

The inserter 900, being provided on the finisher 500, separates bundles of sheets including front cover, intermediate insertion sheet or/and back cover stacked on a tray 901 in sequence, and carries them to the finisher path 552 or the bookbinding path 553. On the tray 901 of the inserter 900, the special sheets are stacked in normal view for the operator, in other words, the special sheets are stacked on the tray 901 with the front surface faced upward.

The special sheets on the tray 901 is carried to the separation unit including a carrier roller 903 and a separation belt 904 by a feed roller 902, and carried one by one separately from the top sheet in sequence.

A pair of drawing rollers 905 are disposed downstream of the separation unit, and the special sheet separated by the pair of drawing rollers 905 is led to the carrier path 908 in a stable manner. Provided downstream of the pair of drawing rollers 905 is a paper feed sensor 907, and provided between the paper feed sensor 907 and the pair of entrance rollers 502 is a carrier roller 906 for leading the special sheets on the carrier path 908 to the pair of entrance rollers 502.

(Block Diagram of the Finisher)

Figure 4:
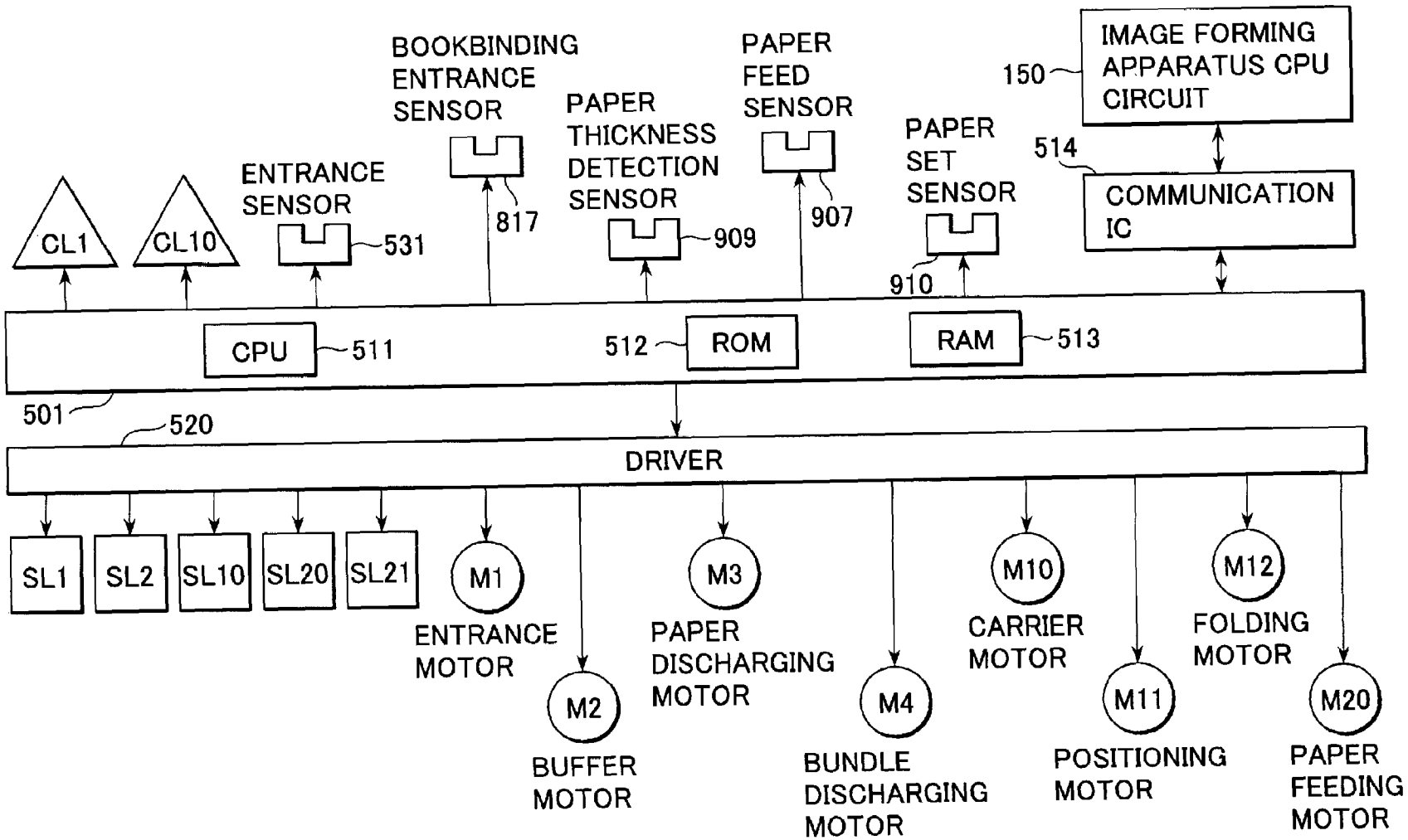
FIG. 4 is a block diagram of the finisher controller.

Referring now to FIG. 4, the structure of the finisher controller 501 for controlling the operation of the finisher 500 will be described. FIG. 4 is a block diagram showing the structure of the finisher controller shown in FIG. 2.

The finisher controller 501 includes, as shown in FIG. 4, a CPU 511, a ROM 512, and a RAM 513. The finisher controller 501 communicates and exchanges data with the CPU circuit unit 150 provided on the main body of the image forming apparatus via a communication IC 514, and controls the operation of the finisher 500 by implementing various programs stored in the ROM 512 based on the instructions from the CPU circuit unit 150.

When controlling the operation, detected signals from the respective sensors are fed into the CPU circuit unit 150. These sensors includes an entrance sensor 531, a bookbinding entrance sensor 817, a paper feed sensor 907, a paper set sensor 910, and a paper thickness detection sensor 909. The paper set sensor 910 is a sensor for detecting whether or not the special sheets are set on the tray 901 of the inserter 900. A driver 520 is connected to the finisher controller 501, and actuates the motor and the solenoid based on the signal from the finisher controller 501. The CPU circuit unit 150 actuates the clutch.

The motors includes a entrance motor M1 as a driving source of the pair of entrance rollers 502, the pair of carrier rollers 503, and the pair of carrier rollers 906, a buffer motor M2 as a driving source of the buffer roller 505, a paper discharging motor M3 as a driving source of the pair of carrier rollers 506, the pair of discharge rollers 507, and the pair of discharge rollers 509, a bundle discharging motor M4 for actuating the respective discharge rollers 680*a*, 680*b*, a carrier motor M10 as a driving source of the pair of carrier rollers 813, a positioning motor M11 as a driving source of the sheet positioning member 823, a folding motor M12 as a driving source of the projecting member 825, the pair of folding rollers 826, and the pair of folded paper discharge rollers 827, and a paper feeding motor M20 as a driving source of the paper feed roller 902, the carrier roller 903, the separation belt 904, and the pair of drawing rollers 905 of the inserter 900.

The entrance motor M1, the buffer motor M2, the paper discharging motor M3 are stepping motors, and are capable of rotating the pair of rollers driven by the respective motors at a constant velocity or of rotating at individual velocities by controlling the exciting pulse rate. The entrance motor M1 and the buffer motor M2 are capable of driving in the forward and reverse directions by a driver 520.

The carrier motor M10 and the positioning motor M11 are stepping motors, and the folding motor M12 is a DC motor. The carrier motor M10 is adapted to be capable of transferring the sheets at the same velocity with the entrance motor M1.

The paper feeding motor M20 is a stepping motor, and is adapted to be capable of transferring the sheets at the same velocity as the entrance motor M1.

The solenoids include a solenoid SL1 for switching the switchover flapper 510, a solenoid SL2 for switching the switchover flapper 511, a solenoid SL10 for switching the switchover flapper 551, a solenoid SL20 for driving the paper feed shutter (not shown in FIG. 3) of the inserter 900, and a solenoid SL21 for moving the paper feed roller 902 of the inserter 900 in the vertical direction.

The clutches includes a clutch CL1 for transmitting the drive force of the folding motor M12 to the projecting member 825, and a clutch CL10 for transmitting a drive force of the paper feeding motor M20 to the paper feed roller 902.

The paper thickness detection sensor 909 for detecting the thickness of the sheet is disposed on the finisher path 552 downstream of the meeting point of the path 908 from the inserter 900 and the path from the image forming apparatus 10. In this manner, the image forming apparatus of this embodiment includes a first stacking unit for stacking regular sheets on which images are to be formed (cassette 114), an image forming unit for forming an image on the regular sheet fed from the first stacking unit (image forming apparatus 10), a second stacking unit for stacking insertion sheets (tray 901), a delivery unit for discharging regular sheets from the image forming unit and the insertion sheets from the second stacking unit to a single paper discharge section (700) (finisher 500), and a paper thickness detection unit provided on the common carrier path (finisher path 552) through which the regular sheets carried from the image forming unit and the insertion sheets fed from the second stacking unit for detecting the thickness of the regular sheet and the insertion sheet (paper thickness detection sensor 909). The paper thickness detection unit (the paper thickness detection sensor 909) is provided downstream of the meeting point of the path from the first stacking unit (908) and the path from the image forming unit (911). The second stacking unit (tray 901) is provided downstream of the image forming unit (image forming apparatus 10).

(Operation Panel)

Referring now to FIG. 5, an example of an operation to select the post-process mode using the operation panel 153 will be described. FIG. 5 shows examples of displays used in post-process mode selection on the operation panel of the image forming apparatus shown in FIG. 1.

Figure 5A:
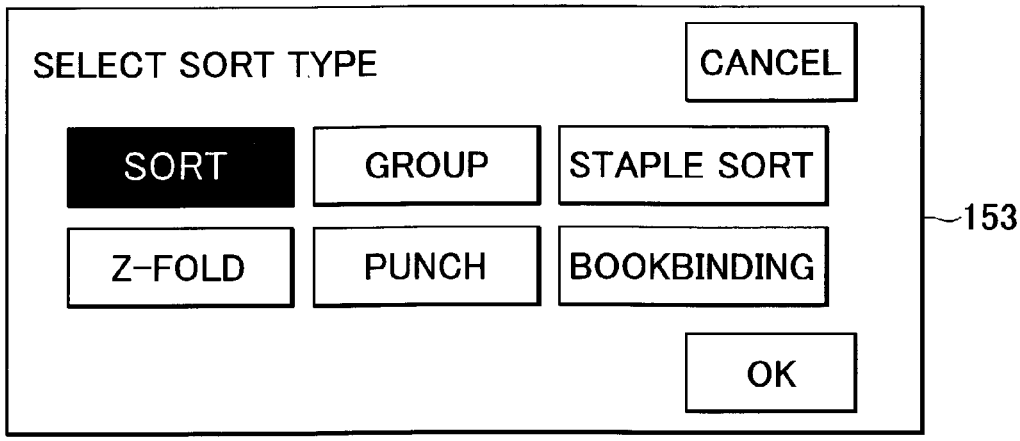
FIG. 5 shows an example of a display relating to an after-process mode selection of the operation panel.
Figure 5B:
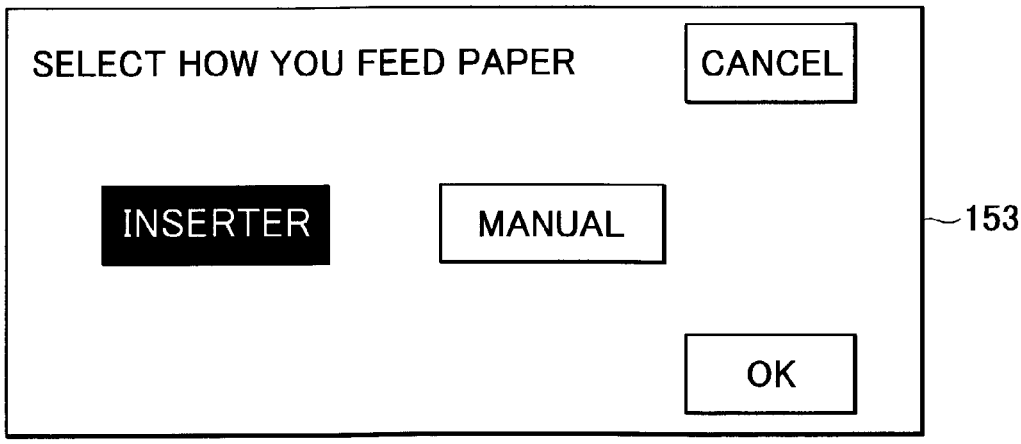
Figure 5C:
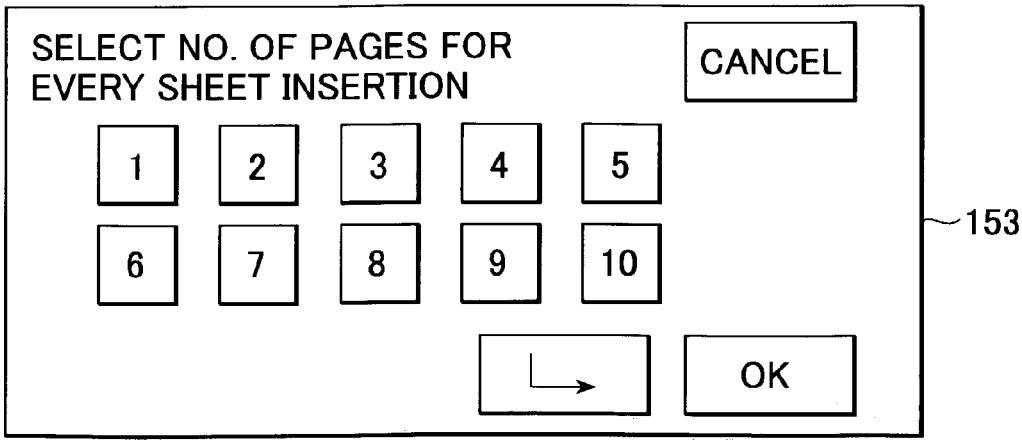

The image forming apparatus of the invention has post-process modes including various process modes such as a non-sort mode, a sort mode, a staple sort mode (binding mode) and a bookbinding mode, and is adapted to be capable of inserting the insertion sheets such as a front cover, a back cover, or an intermediate insertion sheet in the insertion mode. Setting of these modes are made by the input operation through the operation panel 153. For example, when setting the post-process mode, the menu selection display shown in FIG. 5A is displayed on the operation panel 153, through which the post-process mode may be set. When setting the insertion mode, the insertion setting display shown in FIG. 5B is displayed on the operation panel 153, through which whether the operator wants to insert the front cover and the like by the inserter 900 or from manual paper feeder 125 may be selected. Then, through the display shown in FIG. 5C, the ordinal page numbers the operator wants to insert the insertion sheets may be set. When feeding the front cover only from the inserter 900, the operator selects the number "1", and when feeding a plurality of sheets, the operator may select the desired ordinal page numbers.

(Outline of Operation of Finisher)

Referring now to FIG. 6 through FIG. 9, the sheets conveyance from the inserter 900 and the printer 300 into the process tray 630 in the finisher 500 in the sort mode will be described. FIG. 6 through FIG. 9 are explanatory drawings illustrating the flow of the sheets from the inserter and the printer into the process tray in the finisher in the image forming apparatus shown in FIG. 1 when the sort mode is selected. The bookbinding unit is omitted for the sake of explanatory convenience.

Figure 6:
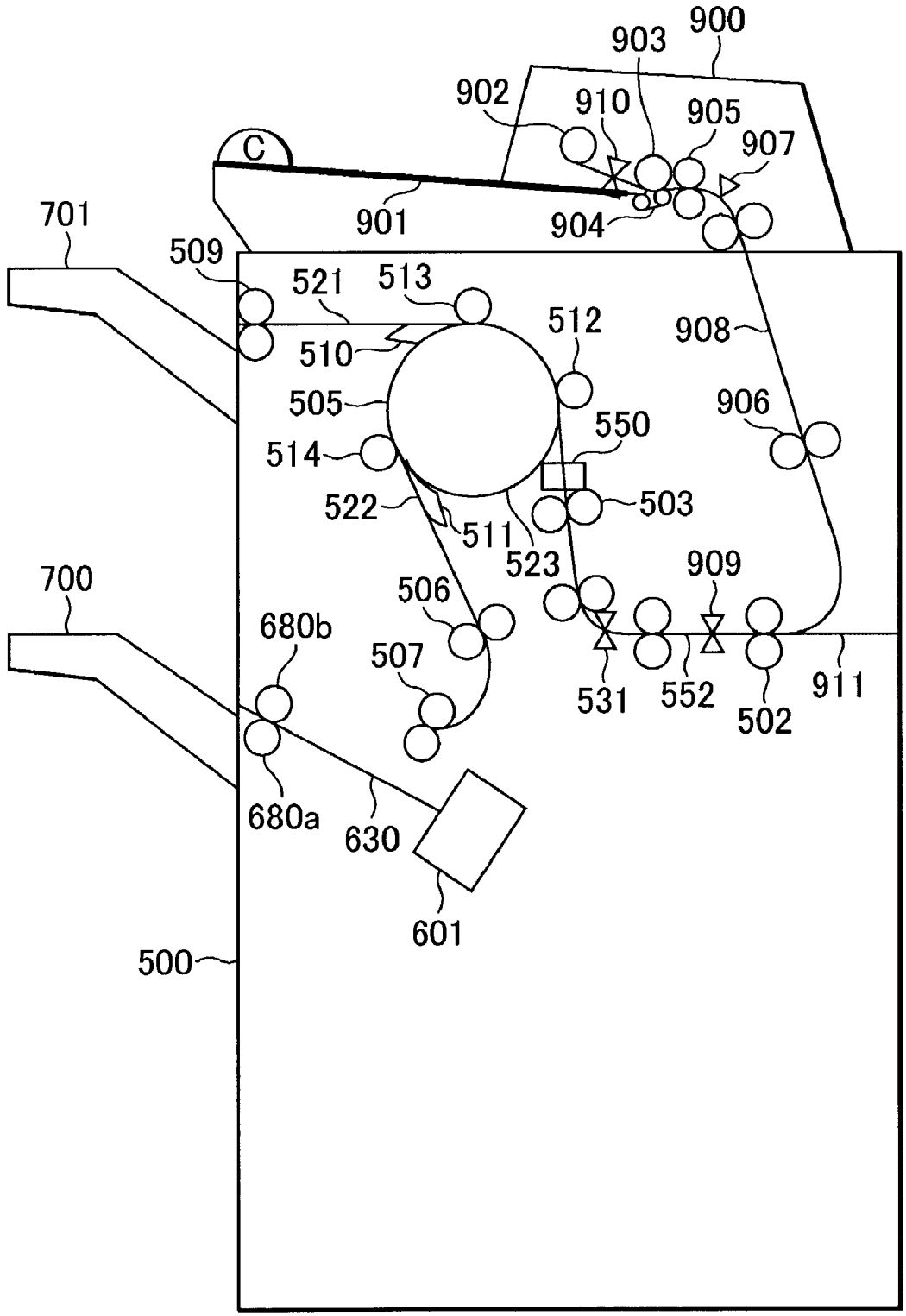
FIG. 6 is an explanatory drawing illustrating a flow of a sheet into a process tray in the finisher.

When inserting the sheets C as a front cover into the regular sheets on which the images are already formed, as shown in FIG. 6, the operator sets the sheets C on the tray 901 of the inserter 900.

Figure 7:
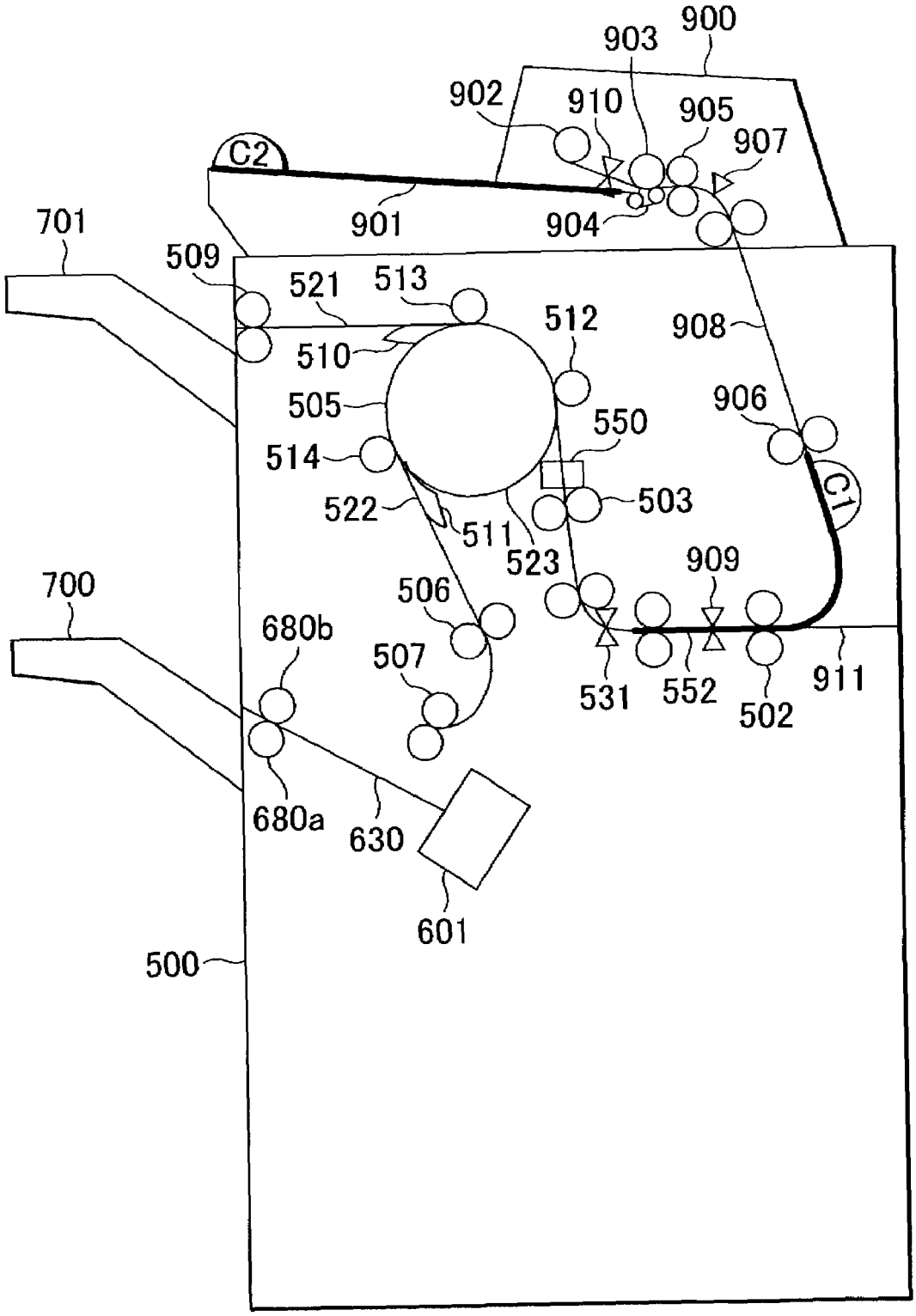
FIG. 7 is an explanatory drawing illustrating a flow of a sheet into a process tray in the finisher.

When the sheets C are set on the tray 901, the uppermost sheet C1 starts to be fed as shown in FIG. 7, and the switchover flapper 551 is switched toward the finisher path 552. The sheet C1 is led from the carrier path 908 through the pair of entrance rollers 502 into the finisher path 552. When the entrance sensor 531 detects the leading edge of the sheet C1, the regular sheet (sheet P1 in FIG. 8) on which the image is already formed starts to be fed from the printer 300.

Subsequently, the sheet P1 fed from the printer 300 is guided into the finisher 500, and the sheet C1 is guided into the sort path 522 via the buffer roller 505. At this moment, both of the switchover flappers 510, 511 are switched toward the sort path 522.

Figure 8:
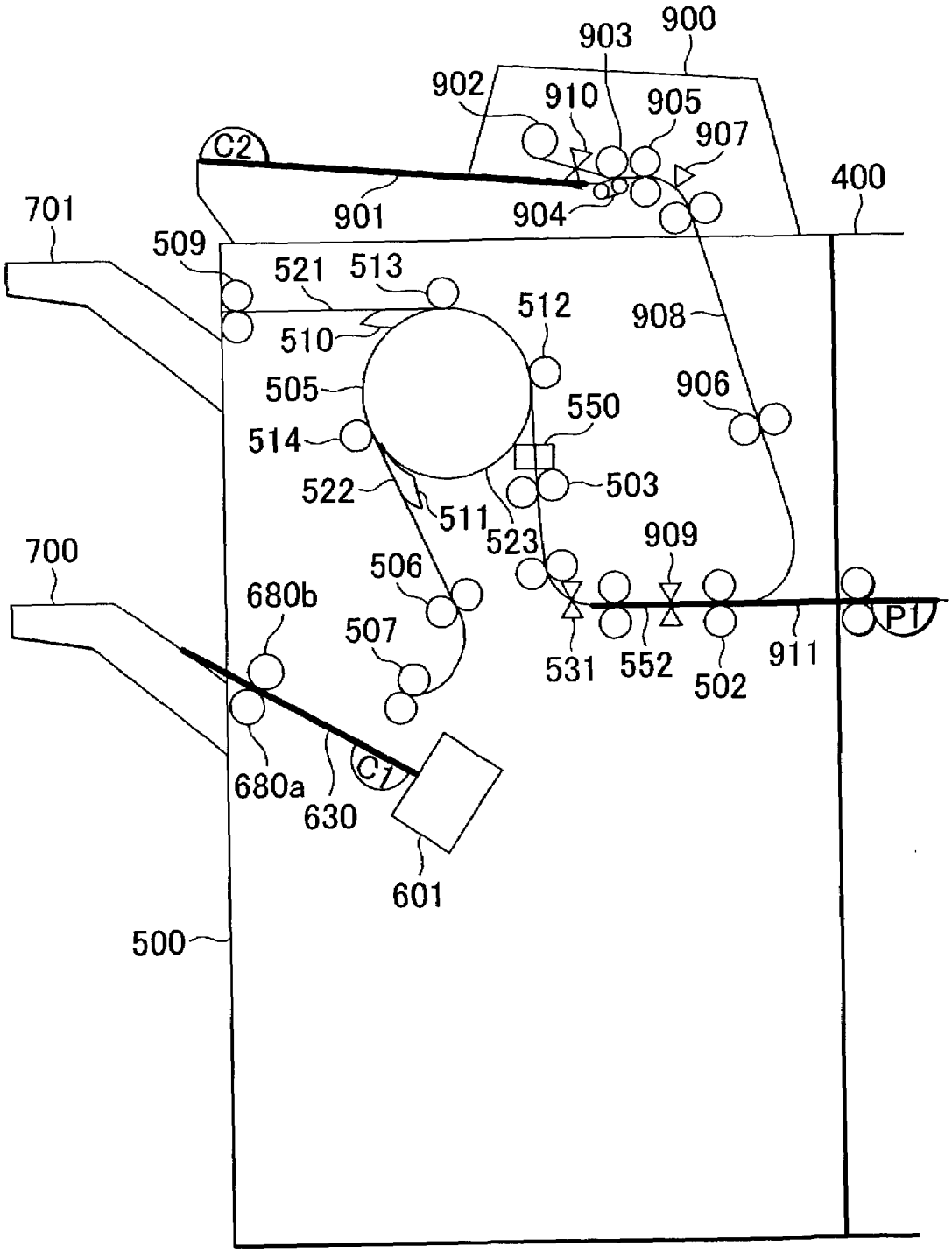
FIG. 8 is an explanatory drawing illustrating a flow of a sheet into a process tray in the finisher.
Figure 9:
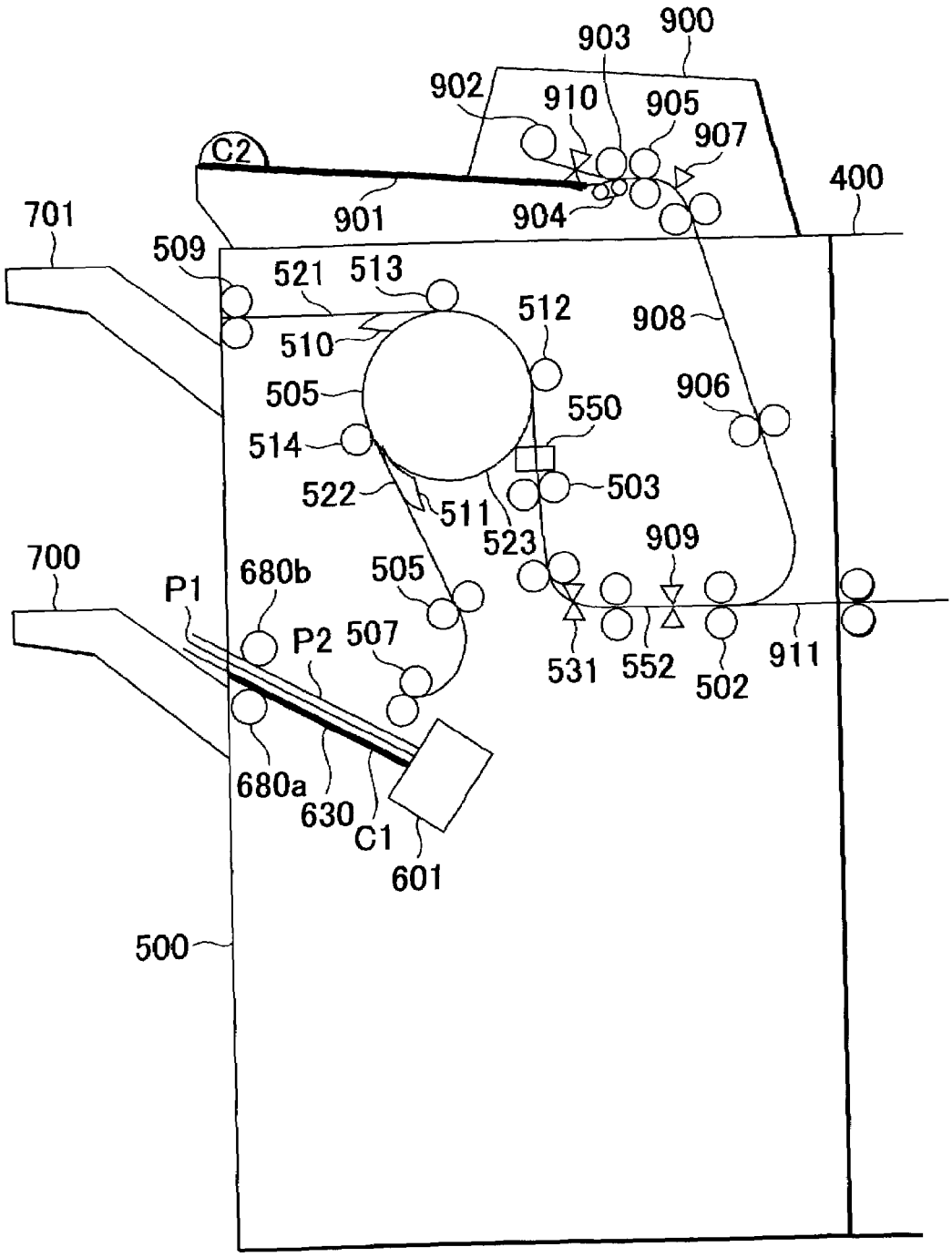
FIG. 9 is an explanatory drawing illustrating a flow of a sheet into a process tray in the finisher.

The sheet C1 led into the sort path 522 is stored on the process tray 630 as shown in FIG. 8. At this moment, the sheet P1 from the printer 300 is led into the finisher path 552. The sheet P1 is led into the sort path 522 via the buffer roller 505 and carried toward the process tray 630 as in the case of the sheet C1, and the sheet P2 subsequent to the sheet P1 is led into the finisher path 552. As shown in FIG. 9, the sheet P1 is stored on the sheet C1 which is already store in the process tray 630 in piles, and then the subsequent sheet P2 is stored on the sheet P1 in piles.

Since the respective sheets P1, P2 from the printer 300 are formed with mirror images and the sheets P1, P2 are discharged by reverse discharge, the sheets P1 and P2 are stored in the process tray 630 with the images facing downward and with the binding position facing toward the stapler 601 as in the case of the sheet C1. Though it is not shown in the FIG. 9, when the special sheet for the next bundle exists, it is adapted to feed the special sheets to the carrier path 908 and let it stand as the sheets P1, P2 which constitute the present bundle are being fed. This construction may improve the productivity during the process in the sort mode.

(Paper Thickness Detection Sensor)

Figure 10:
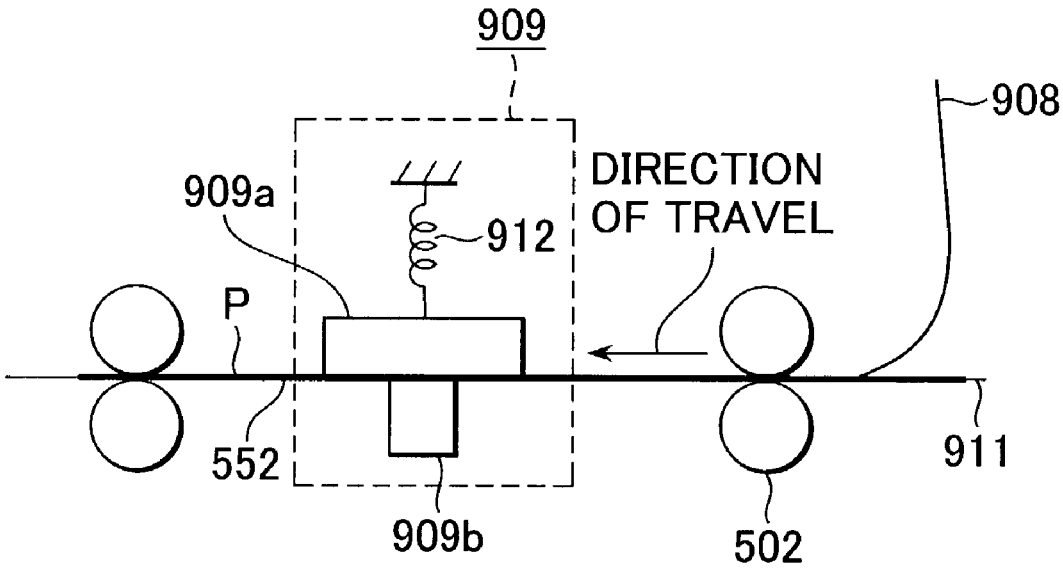
FIG. 10 is an explanatory drawing illustrating a paper thickness detection sensor.

Referring now to FIG. 10, the paper thickness detection sensor 909 will be described. The paper thickness detection sensor 909 includes a movable core 909*a* formed of magnetic material and a magnetic field sensor 909*b* using a Hall element. The movable core 909*a* is urged toward the magnetic field sensor 909*b* by a spring 912 set at an appropriate force. The sheet P is guided between the movable core 909*a* and the magnetic field sensor 909*b*, and thus the position of the movable core 909*a* is displaced according to the thickness of the sheet P, whereby the magnitude of the magnetic field generated by the movable core 909*a* detected by the magnetic field sensor 909*b* varies correspondingly. At this moment, signals fed from the magnetic field sensor 909*b* are signals corresponding to the thickness of the sheet P. In this manner, according to this embodiment, the paper thickness detection unit (paper thickness detection sensor 909) includes the movable magnetic body (movable core 909*a*) and the magnetic field sensor (909*b*).

(Detection of Overlapped Feeding)

The output of the magnetic field sensor 909*b* is fed to the finisher controller 501, and the finisher controller 501 determines the overlapped feeding of the sheets based on the output from the magnetic field sensor 909*b*. For example, in the sort mode, a plurality of sets of a plurality of sheets may be placed on the inserter tray 901.

Figure 11:
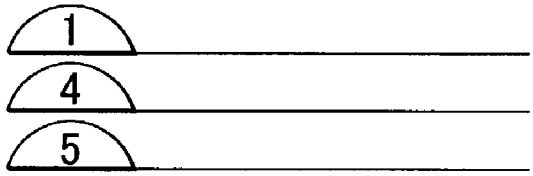
FIG. 11 is a drawing showing a manuscript placed on a manuscript feed unit in an insertion mode.
Figure 12:
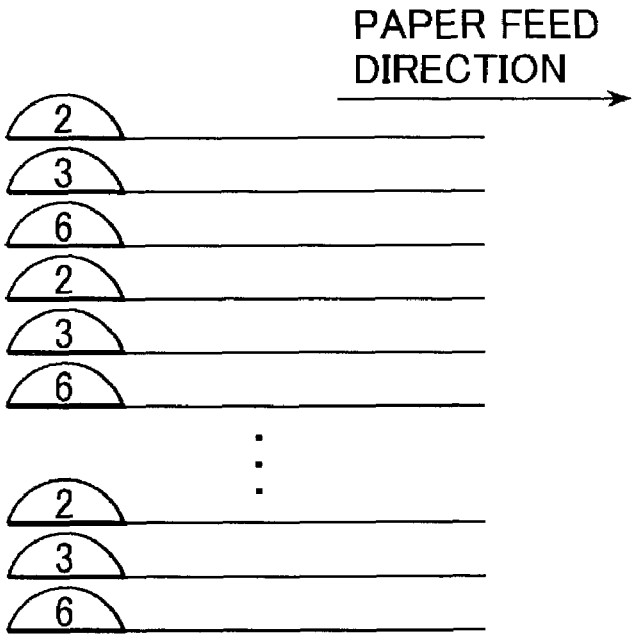
FIG. 12 shows an insertion sheet placed on an inserter in the insertion mode.

For example, there is a case in which a bundle includes six sheets, and the second, third, and sixth sheets are formed with images by a color image forming apparatus (not shown), and the first, fourth, and fifth sheets are formed with images with the image forming apparatus 10, and then these sheets are put together into a bundle in order of their page numbers. The user places manuscripts for the first, fourth, and fifth pages on the manuscript feed unit 100 as shown in FIG. 11, and places the second, third, and sixth sheets on which the images are already formed thereon (formed with image by a color image forming apparatus or the like) on the inserter tray 901 in piles by the required number of copies as shown in FIG. 12.

When detecting the existence of overlapped feeding, if it is in the insertion mode, the thicknesses of the insertion sheet and the regular sheet are measured by the paper thickness detection unit 909 when the first copy (first bundle) is made, and the measured thicknesses are stored in the RAM 513 for every page (d1, d2, . . . dn, where 1-n designate the page number).

The paper thickness data is used as a reference value for determining overlapped feeding of the sheets from the next bundle onward. When making the next and subsequent bundles, the paper thickness for each sheet is measured when passing through the paper thickness detection sensor, and the paper thickness data Xn of the nth page is compared to the paper thickness data dn stored in the RAM 513. When the expression;

$$Xn > \alpha \times dn \text{(where } \alpha = 1.5\text{)}$$

is satisfied, it is determined that overlapped feeding has occurred.

In this embodiment, the paper thickness detection sensor 909 is disposed downstream of the meeting point of the path 911 for carrying the regular sheets on which the images are already formed thereon and the carrier path 908 for carrying the insertion sheets.

In this arrangement, it is not necessary to mount the costly paper thickness detection sensors on the regular sheets feed units 114, 115 and the carrier path 908 of the inserter 900 respectively, thereby reducing the costs.

Since a single paper thickness detection sensor 909 learns the paper thickness data of the regular paper and the insertion paper, control at the time of learning the paper thickness data while the first copy (first bundle) is being made is advantageously prevented from being complicated.

Figure 14:
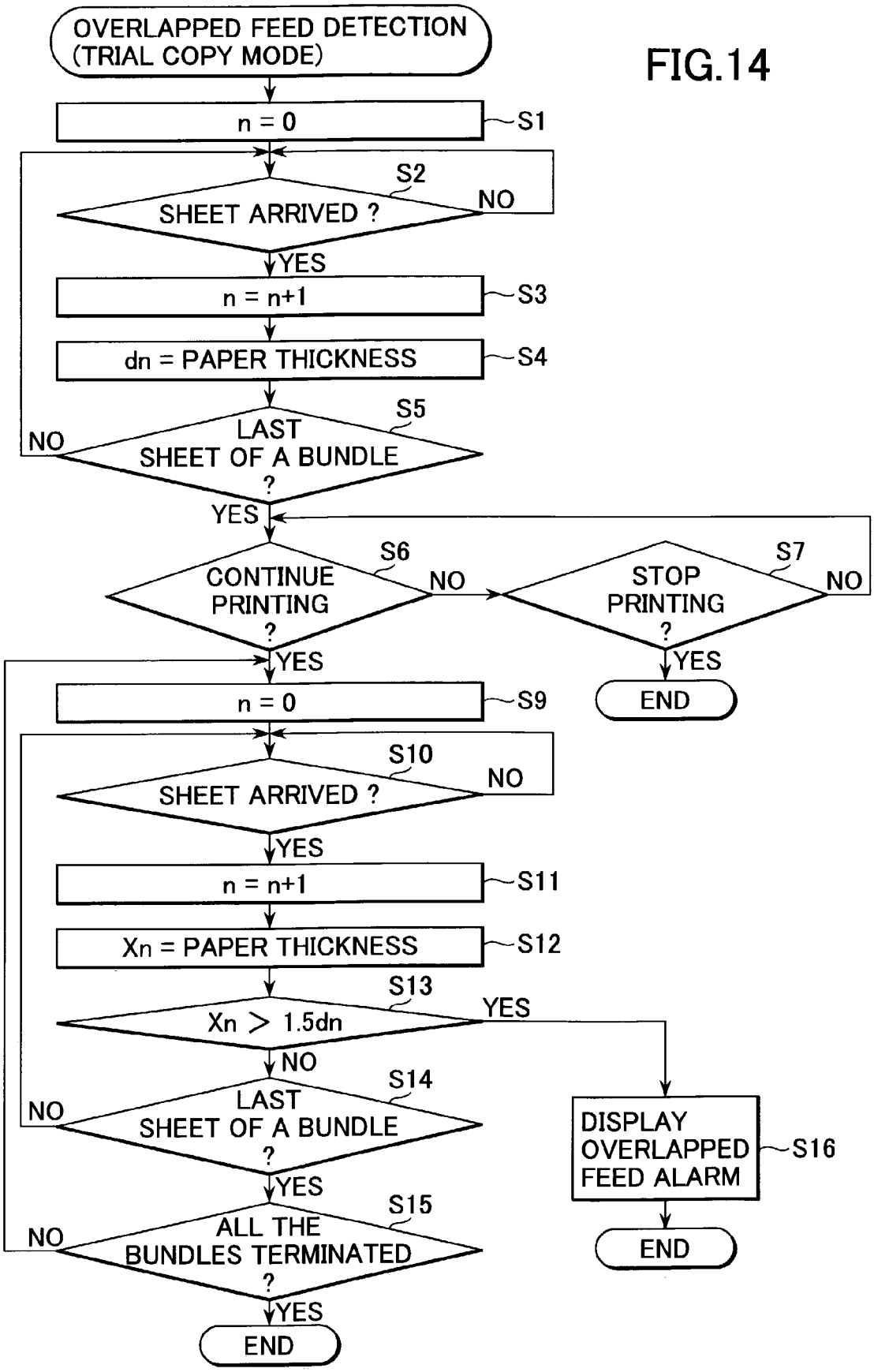
FIG. 14 is a flowchart illustrating overlapped feed detecting process in a trial copy mode.

FIG. 14 is a flowchart of the overlapped feeding detection process described above, and, more specifically, of the overlapped feed detection process when the trial copy mode is set. This flowchart is implemented by the finisher controller 501 and/or by the CPU circuit unit 150. In a first place, the variable n is set to zero (Step S1), and when the sheet reaches the finisher 500 (Step S2), the variable n is increased by one (Step S3). Subsequently, the paper thickness data detected by the paper thickness detection sensor 909 is set to a variable dn (when the variable n is 1, dn=d1) (Step S4), and repeats Steps S2–S4 until the last sheet of a bundle and the last insertion sheet is fed (Step S5). When the last sheet of the bundle reaches the finisher 500 in Step S5, "Trial copy is made, Do you want to continue printing? continue/cancel" is displayed on the operation panel 153, and the apparatus waits until it receives the instruction to continue printing from the operation panel 153 (Step S6). At this time, when the instruction not to continue printing is issued from the operation panel 153, this process is terminated (step S7).

When the instruction to continue printing is issued in Step S6, the variable n is set to zero (Step S9) and feeding of regular sheets from the cassette 114 of the image forming apparatus 10 and feeding of the insertion sheet from the inserter 900 is restarted. When the sheet reaches the finisher 500 (Step S10), the variable n is increased by one (Step S11). Then the paper thickness data detected by the paper thickness detection sensor 909 is set to Xn (when the variable n is 1, the variable Xn=X1)(Step S12), and whether or not Xn>1.5×dn is determined (Step S13). When Xn>1.5×dn in Step S13, a warning notifying the user of an overlapped feeding is displayed on the operation panel 153 (Step S16), and the process is terminated. When Xn≦1.5×dn in Step S13, whether or not the last sheet of a bundle has reached is determined (Step S14). If it is not the last sheet in the bundle, the procedure returnd to Step S10, and when it is the last sheet of a bundle, whether or not all the bundles are finished is determined (Step S15). When all the bundles are not finished in Step S15, the procedure goes to Step S9, and when all the bundles are finished, the process is terminated.

As is described above, since the user inspects whether the first bundle is normal or not in the trial copy mode, the second and subsequent copies are processed after it is confirmed that no overlapped feeding occurred in the first bundle. In other words, when paper thickness information of each page from the second copy onward differs from paper thickness information of each page stored during processing the first bundle, it can be determined that overlapped feeding occurred. Therefore, when overlapped feeding occurred during trial copy (first bundle), occurrence of overlapped feeding is proved before starting image formation from the second bundle onward, and when overlapped feeding occurred during process from the second copy onward, occurrence of overlapped feeding is proved immediately when overlapped feeding is detected at the finisher 900. Therefore, waste of image formation after occurrence of overlapped feeding may be prevented, and accurate detection of overlapped feeding from the second copy onward may be realized.

Figure 15:
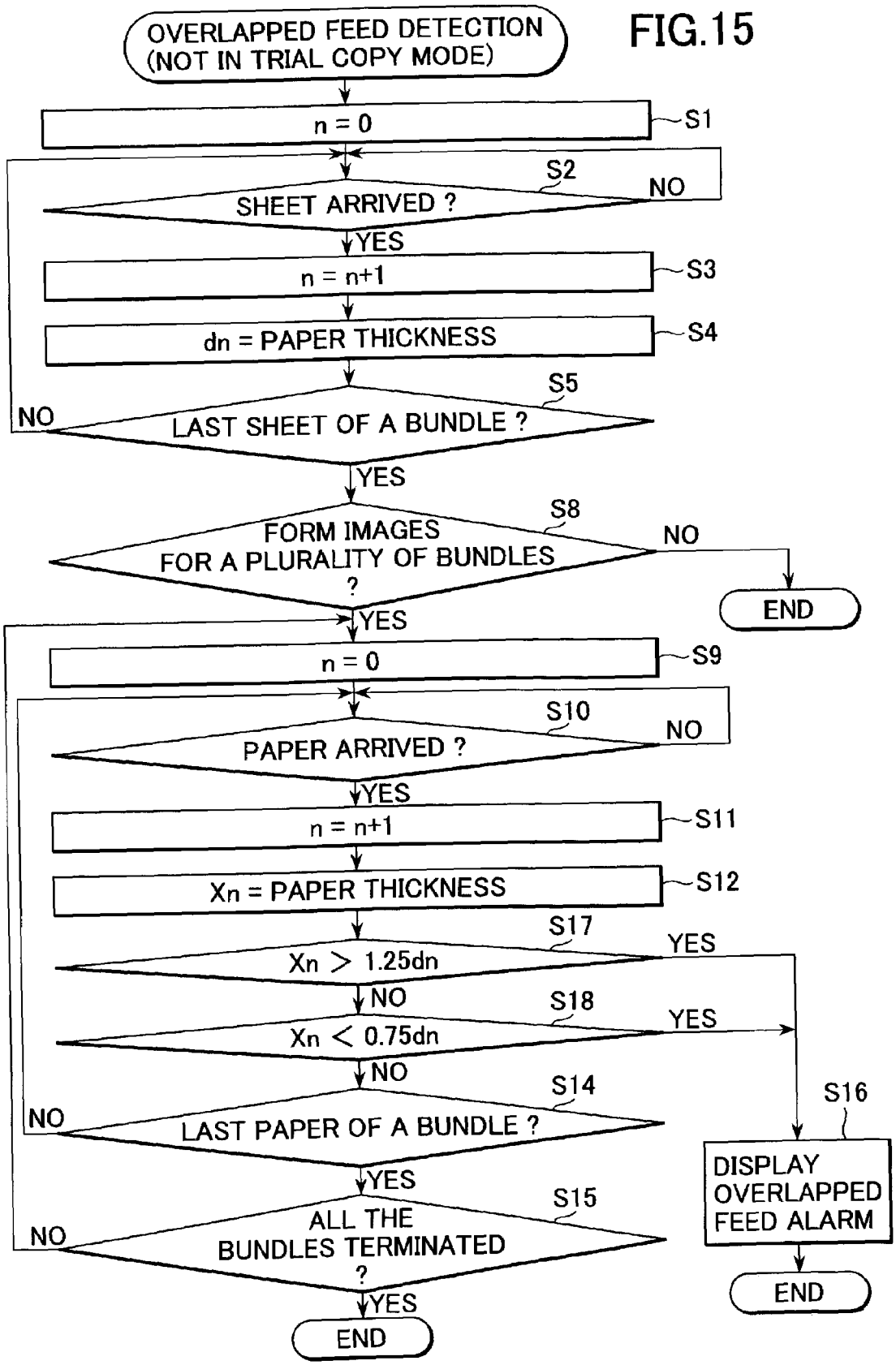
FIG. 15 is a flowchart illustrating overlapped feed detecting process when a trial copy is not performed.

FIG. 15 is a flowchart of the process of overlapped feeding detection when the trial copy mode is not presupposed. This flowchart is implemented and processed by the finisher controller 501 and/or the CPU circuit unit 150. Since the step S1–S5 are the same as in FIG. 14, the description will not be repeated. When the last sheet of a bundle arrived in Step S5, whether or not it is set to form images for a plurality of bundles is determined (Step S8). If it is not set to form images for a plurality of bundles, the process is terminated. If it is set to form images for a plurality of bundles in Step S8, the procedure goes to Step S9. Since Steps S9–S12 are the same as FIG. 14, the description will not be repeated again.

After Step S12, whether or not Xn>1.25×dn is determined (Step S17). When Xn>1.25×dn, a warning notifying the user of an overlapped feeding is issued on the operation panel 153 (Step S16), and the process is terminated. When Xn≦1.25×dn in Step S17, whether or not Xn<0.75×dn is determined (Step S18). When Xn<0.75×dn, a warning notifying the user of an overlapped feeding is issued on the operation panel 153 (Step S16), and the process is terminated. When Xn≧0.75×dn in Step 18, the procedure goes to Step S14. Since Steps S14 and S15 are the same as in FIG. 14, the description will not be repeated.

As described above, when the trial copying is not presupposed, occurrence of overlapped feeding in the first bundle may be proved by determining whether or not Xn<0.75×dn. When overlapped feeding has occurred during processing from the second copy onward, occurrence of overlapped feeding may be proved immediately when overlapped feeding is detected in the finisher 900 by determining whether or not Xn>1.25×dn. Therefore, waste of image formation after occurrence of overlapped feeding may be prevented.

As is described above, the image forming apparatus according to this embodiment includes a first stacking unit for stacking regular sheets on which images are to be formed (cassette 114), an image forming unit for forming an image on the regular sheet fed from the first stacking unit (image forming apparatus 10), a second stacking unit for stacking insertion sheets (tray 901), a delivery unit for discharging regular sheets from the image forming unit and the insertion sheets from the second stacking unit to a single paper discharge section (stack tray 700) (finisher 500), a paper thickness detection unit provided on the common carrier path (finisher path 552) through which the regular sheets carried from the image forming unit and the insertion sheets fed from the second stacking unit for detecting the thickness of the regular sheet and the insertion sheet (paper thickness detection sensor 909), and a comparing unit for comparing the thickness of each page of the first copy detected by the paper thickness detection unit with the thickness of each page from the second copy onward (Steps S13, S17, and S18), and a warning unit for providing a warning notifying the user of an overlapped feeding of the regular sheet or the insertion sheet according to the comparison result obtained by the comparing unit (Step S16, operation panel 153), wherein the warning unit provides a warning notifying the user of an overlapped feeding when the thickness of the each page from the second copy onward is larger than the value by multiplying the thickness of each page of the first copy by a predetermined coefficient(Steps S13, S17).

The image forming apparatus according to this embodiment includes a first stacking unit for stacking regular sheets on which images are to be formed (cassette 114), an image forming unit for forming an image on the regular sheet fed from the first stacking unit (image forming apparatus 10), a second stacking unit for stacking insertion sheets (tray 901), a delivery unit for discharging regular sheets from the image forming unit and the insertion sheets from the second stacking unit to a single paper discharge section (stack tray 700) (finisher 500), a paper thickness detection unit for detecting the thicknesses of the insertion sheet fed from the second stacking unit to and the regular sheet carried from the image forming unit (paper thickness detection sensor 909), a feed control unit (CPU circuit unit 150, finisher controller 501) for suspending feed of the regular sheets and the insertion sheets (Step S6 NO→S7 NO→S6) in accordance with completing the feed of all regular sheets and all insertion sheets of the first copy (Step S5 YES) and restarting feed of the regular sheets and the insertion sheets from the second copy onward when a continuation instruction is issued from the operation panel(Step S6 YES), and a warning unit (Steps S13, S16, operation panel 153) for providing a warning notifying the user of an overlapped feeding when the thickness of the each page from the second copy onward is larger than the value obtained by multiplying the thickness of each page of the first copy by a predetermined coefficient.

Second Embodiment

Figure 13:
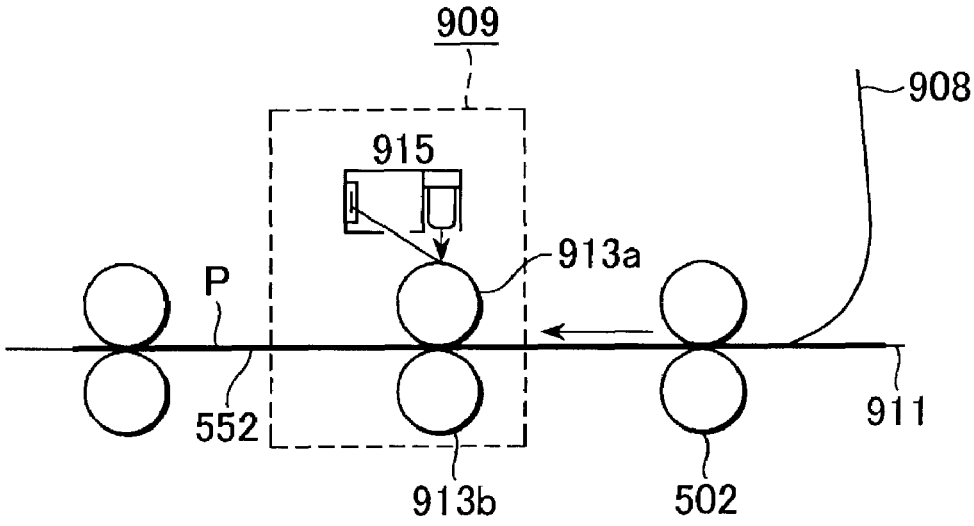
FIG. 13 is an explanatory drawing illustrating the paper thickness detection sensor.

In the embodiment described above, the paper thickness detection sensor 909 includes the movable core 909*a* and the magnetic field sensor 909*b* shown in FIG. 10. However, as shown in FIG. 13, it may be constructed of at least a pair of sheet clamping rollers 913*a*, 913*b* disposed on the finisher path 552, and a micro displacement sensor 915 for detecting the amount of displacement radially of at least one of the rollers when the sheet is clamped between the pair of sheet clamping rollers.

When the sheet clamping roller 913*a* is displaced toward the micro displacement sensor 915 depending on the thickness of the sheet P, the position of light entering into the light receiving unit of the micro displacement sensor is changed and the output from the light receiving unit of the micro displacement sensor is also changed. The paper thickness may be measured based on this output. Determination of overlapped feeding is not described here because it is the same as in the previous embodiment. In this way, according to the second embodiment, the paper thickness detection unit (paper thickness detection sensor 909) includes a pair of rollers (a pair of sheet clamping rollers 913*a*, 913*b*) and the amount of displacement detection unit (micro displacement sensor 915) for detecting the amount of displacement of at least one of the rollers.

As is described thus far, since there are provided the first stacking unit for stacking regular sheets on which images are to be formed, the image forming unit for forming an image on the regular sheet fed from the first stacking unit, the second stacking unit for stacking insertion sheets, the delivery unit for discharging regular sheets from the image forming unit and the insertion sheets from the second stacking unit to a single paper discharge section, and the paper thickness detection unit provided on the common carrier path through which the regular sheets carried from the image forming unit and the insertion sheet fed from the second stacking unit for detecting the thickness of the regular sheet and the insertion sheet, it is not necessary to provide costly paper thickness detection units at a plurality of points, and the thicknesses of the regular sheet from the image forming unit and the insertion sheet from the second stacking unit may be detected in a less expensive and simple construction.

Since there are provided the comparing unit for comparing the thickness of each page of the first copy detected by the paper thickness detection unit and the thickness of each page from the second copy onward, and the warning unit for providing a warning notifying the user of an overlapped feeding of the regular sheets or the insertion sheets depending on the comparison result obtained by the comparing unit, overlapped feeding of the regular sheets or the insertion sheets may be detected and notified as a warning in a less expensive and simple construction, waste of image forming due to overlapped feeding may be prevented.

Since there are provided the first stacking unit for stacking regular sheets on which images are to be formed, the image forming unit for forming an image on the regular sheet fed from the first stacking unit, the second stacking unit for stacking insertion sheets, the delivery unit for discharging regular sheets from the image forming unit and the insertion sheets from the second stacking unit to a single paper discharge section, the paper thickness detection unit for detecting the thicknesses of the insertion sheet fed from the second stacking unit and the regular sheet carried from the image forming unit, the feed control unit for suspending feed of the regular sheets and the insertion sheets in accordance with the feed of the regular sheet and the insertion sheets of the first copy and restarting feed of the regular sheets and the insertion sheets from the second copy onward when a continuation instruction is issued from the operation panel, and a warning unit for providing a warning notifying the user of an overlapped feeding when the thickness of the each page from the second copy onward is larger than the value obtained by multiplying the thickness of each page of the first copy by a predetermined coefficient, overlapped feeding of the regular sheets or the insertion sheets may be detected and notified as a warning in a simple construction, and in addition, since overlapped feeding of the regular sheet or the insertion sheet from the second copy onward are detected based on the paper thickness information of each page in the first copy that is directly inspected by the user, accurate detection of overlapped feeding may be realized in a simple construction.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus comprising:

a first stacking unit for stacking regular sheets;

an image forming unit for forming an image on a regular sheet fed from the first stacking unit;

a second stacking unit for stacking insertion sheets;

a delivery unit for discharging the insertion sheets fed from the second stacking unit to a sheet discharge section wherein at least a portion of a path traveled by the regular sheets from said image forming unit to said discharge section and a path traveled by the insertion sheets from said second stacking unit to said discharge section form a common carrier path;

a paper thickness detection unit, provided on the common carrier path through which the regular sheets carried from the image forming unit and the insertion sheets delivered from the second stacking unit are transported, for detecting the thickness of the regular sheet and the insertion sheet, wherein said paper thickness detection unit comprises a movable magnetic body and a magnetic field sensor; and a warning unit comprising an operation panel on which a warning is displayed notifying the user of an overlapped feeding condition in accordance with a thickness of each page of a first set and a thickness of each page from a second set onward.

2. An image forming apparatus comprising:

a first stacking unit for stacking regular sheets;

an image forming unit for forming an image on a regular sheet fed from the first stacking unit;

a second stacking unit for stacking insertion sheets;

a delivery unit for discharging the insertion sheets fed from the second stacking unit to a sheet discharge section wherein at least a portion of a path traveled by the regular sheets from said image forming unit to said discharge section and a path traveled by the insertion sheets from said second stacking unit to said discharge section form a common carrier path;

a paper thickness detection unit, provided on the common carrier path through which the regular sheets carried from the image forming unit and the insertion sheets delivered from the second stacking unit are transported, for detecting the thickness of the regular sheet and the insertion sheet, wherein said paper thickness detection unit is located downstream of an intersection of the path from the first stacking unit and the path from the image forming unit; and a warning unit comprising an operation panel on which a warning is displayed notifying the user of an overlapped feeding condition in accordance with a thickness of each page of a first set and a thickness of each page from a second set onward.

3. An image forming apparatus according to claim 2, wherein said paper thickness detection unit includes a pair of rollers and a displacement detection unit for detecting the amount of displacement of at least one of the rollers.

4. An image forming apparatus comprising:

a first stacking unit for stacking regular sheets;

an image forming unit for forming an image on a regular sheet fed from the first stacking unit;

a second stacking unit for stacking insertion sheets;

a delivery unit for discharging the insertion sheets fed from the second stacking unit to a sheet discharge section wherein at least a portion of a path traveled by the regular sheets from said image forming unit to said discharge section and a path traveled by the insertion sheets from said second stacking unit to said discharge section form a common carrier path;

a paper thickness detection unit, provided on the common carrier path through which the regular sheets carried from the image forming unit and the insertion sheets delivered from the second stacking unit are transported, for detecting the thickness of the regular sheet and the insertion sheet, wherein the second stacking unit is located downstream of the image forming unit; and a warning unit comprising an operation panel on which a warning is displayed notifying the user of an overlapped feeding condition in accordance with a thickness of each page of a first set and a thickness of each page from a second set onward.

5. An image forming apparatus comprising:

a first stacking unit for stacking regular sheets;

an image forming unit for forming an image on a regular sheet fed from the first stacking unit;

a second stacking unit for stacking insertion sheets;

a delivery unit for discharging the insertion sheets fed from the second stacking unit to a sheet discharge section wherein at least a portion of a path traveled by the regular sheets from said image forming unit to said discharge section and a path traveled by the insertion sheets from said second stacking unit to said discharge section form a common carrier path; and a paper thickness detection unit, provided on the common carrier path through which the regular sheets carried from the image forming unit and the insertion sheets delivered from the second stacking unit are transported, for detecting the thickness of the regular sheet and the insertion sheet, wherein the image forming apparatus further comprises a comparing unit for comparing a thickness of each page of a first copy detected by the paper thickness detection unit with a thickness of each page from a second copy onward, and a warning unit comprising an operation panel on which a warning is displayed notifying the user of an overlapped feeding of the regular sheets or the insertion sheets in response to a comparison result of said comparing unit.

6. An image forming apparatus according to claim 5, wherein the warning unit provides a warning notifying the user of an overlapped feeding when the thickness of the each page from the second copy onward is larger than a value obtained by multiplying a thickness of each page of the first copy by a predetermined coefficient.

7. An image forming apparatus comprising:

a first stacking unit for stacking regular sheets;

an image forming unit for forming an image on a regular sheet fed from the first stacking unit;

a second stacking unit for stacking insertion sheets;

a delivery unit for discharging the regular sheets fed from the image forming unit and the insertion sheets from the second stacking unit to a single sheet discharge unit;

a paper thickness detection unit for detecting a thickness of an insertion sheet fed from the second stacking unit and a regular sheet carried from the image forming unit; and a warning unit comprising an operation panel on which a warning is displayed notifying a user of an overlapped feeding condition in accordance with a thickness of each page of a first set and a thickness of each page from a second set onward.

8. An image forming apparatus according to claim 7, further comprising a feed control unit for suspending feed of the regular sheets and the insertion sheets in accordance with the feed of the regular sheets and the insertion sheets of a first set and restarting feed of the regular sheets and the insertion sheets from the second set onward when a continuation instruction is issued from an operation panel.

9. A sheet processing apparatus, which is capable of receiving a sheet transported from an image forming apparatus, said sheet processing apparatus comprising:

a stacking unit for stacking insertion sheets;

a delivery unit for discharging the insertion sheets fed from said stacking unit to a sheet discharge section wherein at least a portion of a path traveled by a sheet from said image forming apparatus to said discharge section and a path traveled by the insertion sheets from said stacking unit to discharge section from a common carrier path; and a paper thickness detection unit, provided on the common carrier path through which the regular sheets carried from said image forming apparatus and the insertion sheets delivered from said stacking unit are transported, for detecting the thickness of the regular sheet and the insertion sheet, a warning unit comprising an operation panel on which a warning is displayed notifying the user of an overlapped feeding condition in accordance with a thickness of each page of a first set and a thickness of each page from a second set onward, wherein said paper thickness detection unit is located downstream of an intersection of the path from said stacking unit and the path from said image forming apparatus.

10. A sheet processing apparatus, which is capable of receiving a sheet transported from an image forming apparatus, said sheet processing apparatus comprising:

a stacking unit for stacking insertion sheets;

a delivery unit for discharging the regular sheets fed from said image forming apparatus and the insertion sheets from said stacking unit to a discharge unit;

a paper thickness detection unit for detecting a thickness of an insertion sheet fed from said stacking unit and a regular sheet carried from said image forming apparatus; and a discrimination unit for discriminating an overlapped feeding condition of the regular sheets or the insertion sheets in accordance with a thickness of each page of a first set and a thickness of each page from a second set onward, said discrimination unit comprising an operation panel on which a warning is displayed notifying the user of the overlapped feeding condition in accordance with the thickness of each page of a first set and the thickness of each page from a second set onward.

* * * * *

UNITED STATES PATENT AND TRADEMARK OFFICE

CERTIFICATE OF CORRECTION

PATENT NO. : 7,062,214 B2
APPLICATION NO. : 10/314290
DATED : June 13, 2006
INVENTOR(S) : Tsuyoshi Moriyama It is certified that error appears in the above-identified patent and that said Letters Patent is hereby corrected as shown below:

TITLE PAGE AT ITEM (56) RC:
Foreign Patent Documents:

"2003263076 9/2003" should read --2003-263076 9/2003--.
"63234268 9/1998" should read --63-234268 9/1998--.
"06321404 11/1994" should read --6-321404 11/1994--.
"09142699 6/1997" should read --9-142699 6/1997--.

COLUMN 2:
Line 55, "cross sectional" should read --cross-sectional--.
Line 60, "cross sectional" should read --cross-sectional--.

COLUMN 3:
Line 24, "cross sectional" should read --cross-sectional--.

COLUMN 4:
Line 54, "imaged" should read --images--.

COLUMN 5:
Line 30, "and" should be deleted.

COLUMN 7:
Line 47, "includes" should read --include--.

UNITED STATES PATENT AND TRADEMARK OFFICE

CERTIFICATE OF CORRECTION

PATENT NO. : 7,062,214 B2
APPLICATION NO. : 10/314290
DATED : June 13, 2006
INVENTOR(S) : Tsuyoshi Moriyama It is certified that error appears in the above-identified patent and that said Letters Patent is hereby corrected as shown below:

COLUMN 9:
Line 53, "store" should read --stored--.

Signed and Sealed this

Twentieth Day of March, 2007

JON W. DUDAS
*Director of the United States Patent and Trademark Office*